US005093072A

United States Patent [19]

Guy et al.

[11] Patent Number: 5,093,072

[45] Date of Patent: Mar. 3, 1992

[54] PROCESS FOR THE RADIOACTIVE DECONTAMINATION OF METAL SURFACES, PARTICULARLY PORTIONS OF PRIMARY CIRCUITS OF WATER-COOLED NUCLEAR REACTORS

[75] Inventors: Brunel Guy, Lauris; Christine Chabrand, Martigues; Jean P. Gauchon, Pertuis, all of France

[73] Assignee: Commissariat A l'Energie Atomique, Paris, France

[21] Appl. No.: 576,453

[22] PCT Filed: Jan. 18, 1990

[86] PCT No.: PCT/FR90/00041

§ 371 Date: Sep. 13, 1990

§ 102(e) Date: Sep. 13, 1990

[87] PCT Pub. No.: WO90/08386

PCT Pub. Date: Jul. 26, 1990

[30] Foreign Application Priority Data

Jan. 19, 1989 [FR] France ..... 89 00604

[51] Int. Cl.[5] ..... G21C 19/42

[52] U.S. Cl. ..... 376/310; 376/305; 376/309

[58] Field of Search ..... 376/306, 305, 309, 310; 252/626, 631; 134/109, 100, 3, 26, 28

[56] References Cited

U.S. PATENT DOCUMENTS 4,476,047 10/1984 Bonnici et al. ..... 252/626
4,587,043 5/1986 Murray et al. ..... 252/626
4,686,067 8/1987 Veysset et al. ..... 252/626

*Primary Examiner*—Donald P. Walsh
*Assistant Examiner*—Meena Chelliah
*Attorney, Agent, or Firm*—Pearne, Gordon, McCoy & Granger

[57] ABSTRACT

Process for the radioactive decontamination of metal surfaces, particularly portions of the primary circuits of water-cooled nuclear reactors, characterized in that it comprises subjecting said surfaces to the successive stages of an oxidizing pretreatment with the aid of a solution of potassium permanganate $KMnO_4$ and nitric acid, rinsing with demineralized water and then reducing treatment in a basic medium with the aid of a solution of alkali metal gluconate of formula $HOH_2C$—CHOH—CHOH—CHOH—CHOH—COOM, in which M is an alkali metal chosen from among Na and K, as well as soda NaOH.

2 Claims, No Drawings

PROCESS FOR THE RADIOACTIVE DECONTAMINATION OF METAL SURFACES, PARTICULARLY PORTIONS OF PRIMARY CIRCUITS OF WATER-COOLED NUCLEAR REACTORS

The present invention relates in general terms to the field of in particular pressurized, water-cooled nuclear reactors.

During the prolonged operation of such reactors, the primary circuit carrying the hot water leaving the core and which is usually largely made from stainless steels (such as e.g. steel 304 L, steel 316 L and/or Inconel 600) becomes internally covered with a layer of metal oxides containing radioactive elements which must be removed as a result of the radioactivity contained therein and which can be prejudicial to personnel during maintenance operations carried out with the reactor shutdown and also during the dismantling thereof.

The elimination or reduction of such a metal oxide layer containing such radioactive elements constitutes the operation called the decontamination of the surface and the essential object of the present invention is to provide a more efficient decontamination process than those of the prior art.

A very small amount of the metallic elements constituting the alloys of the primary circuit of a pressurized water reactor is in solution or suspension in the water of said circuit in the form of oxides (corrosion products). The repeated passage of these elements in the neutron flux of the reactor core activates them.

As a result of the solubilization-precipitation process due to the temperature gradient existing in the primary circuit between its hottest point at approximately 350° C. and its coldest point on reactor shutdown and which can drop to 40° or 50° C., a deposit of corrosion products is formed on the walls of the pipes.

These deposits contain activated elements such as manganese 54, cobalt 58 and cobalt 60 ($\gamma$ radiation emitters), which can be largely responsible for the irradiation of personnel during reactor maintenance work and particularly work carried out on its primary circuit. It is therefore important to be able to eliminate or reduce this background activity by eliminating the oxide layer formed.

In the prior art the internal surface of a primary circuit of a water reactor is decontaminated by a chemical process known as the Citrox process, which involves an oxidizing pretreatment using potassium permanganate and soda, followed by a reducing phase with oxalic and citric acid at pH 3 to 4 and as is described more particularly in the British document "Review of dilute chemical decontamination processes for water cooled in nuclear reactors" NP 1033, Research Project 828-1, Mar. 1979.

However, although this known process is effective from the decontamination standpoint, it can lead to intergranular corrosion in certain sensitive areas of the treated surface which can lead to local, but relatively serious corrosion particularly in the case of structures which have to be exposed to high temperatures and pressures (e.g. in REP: T 350° C., P 160 bars).

The present invention specifically relates to a process for the radioactive decontamination of metal surfaces, which is as simple and effective as the aforementioned prior art process, but which has the additional advantage of having no corrosive action on the surfaces to be decontaminated.

This decontamination process is mainly characterized in that it consists of subjecting said surfaces to the successive stages of an oxidizing pretreatment with the aid of a solution of potassium permanganate $KMnO_4$ and nitric acid, rinsing with demineralized water and a reducing treatment in a basic medium with the aid of a solution of alkali metal gluconate of formula $HOH_2C$—CHOH—CHOH—CHOH—CHOH—COOM, in which M is an alkali metal chosen from among Na and K, as well as soda NaOH.

The interest of this process is essentially based on the reducing treatment phase in the basic medium with the aid of an alkali metal gluconate solution. Thus, whereas the prior art reducing treatment was carried out in a highly acid medium (pH 3 to 4), through working in accordance with the Inventive process in a basic medium with a gluconate acid salt, it is possible to utilize to the maximum the chelation resulting from the existence of the four hydroxyl functions of said acid, which can have their full effect. In the acid medium it is only the carboxylic function which can participate in the chelation, which does not make it possible to obtain the full complexing power of the alkali metal gluconate used.

According to another feature of the process according to the invention, during the oxidizing pretreatment, the solution has a molar composition between 0.006 and 0.1 M. of $KMnO_4$ and a molar composition between 0.035 and 0.1 M. of nitric acid $HNO_3$, the temperature being approximately 80° C. and the pretreatment time approximately 24 h.

According to the invention, the reducing treatment phase in the basic medium is carried out with the aid of a solution having a molar composition of between 0.05 and 1 M. for sodium gluconate and between 0.1 and 1 M. for soda NaOH, the temperature of the solution being approximately 80° C. and its pH approximately 11.

It is as a result of the addition of soda NaOH to the solution that the latter has a marked basic character (because the pH can be close to 11) and the maximum complexing power of the different hydroxyl functions contained in the alkali metal gluconate is obtained.

According to the invention and in a practical manner, the alkali metal used is preferably chosen from among sodium and potassium. The pH of the reducing treatment solution is preferably chosen between extreme values of approximately 9 and 13. Finally, the temperature for the oxidizing pretreatment phase and for the reducing treatment phase is preferably approximately 80±5° C.

The durations of the oxidizing pretreatment and the reducing treatment are generally of the same order of magnitude and vary, as a function of the desired pickling or cleaning, between 6 and 24 h, it being obvious that it is necessary to choose their duration as a function of the particular effect sought in the specific case.

The intermediate rinsing between the two treatments using demineralized water can e.g. last one hour. However, there again the Expert will choose the value appropriate for the case in question.

The effectiveness of the decontamination process according to the invention is due, inter alia, to the fact that the pretreatment embrittles the oxide layer by oxidizing the insoluble compounds into soluble compounds, particularly by oxidizing the chromium III present in large quantities and whose oxide is difficult to dissolve, into chromium VI, whose dichromate ions can be easily dissolved.

The effect obtained with the aid of the reducing treatment in the basic medium using an alkali metal gluconate solution has been explained hereinbefore and results from the increase in the complexing powers of said substance in a basic medium.

It should also be noted that the alkali metal gluconates are in general terms corrosion inhibitors. The process according to the invention consequently has a secondary supplementary and beneficial effect with regards to the protection against corrosion of the pickled surface. Thus, as has been stated hereinbefore, it is the opposite of the prior art Citrox process, which suffered from the major disadvantage of increasing the corrosion of the sensitive areas of the treated surface.

Moreover, alkali metal gluconates are perfectly biodegradable and have no toxicity, which prevents any pollution of the environment and permits an easy, safe performance of the decontamination process according to the invention.

The invention will be better understood from the following description of two performance examples given in an illustrative and non-limitative manner. These examples relate to the treatment of a contaminated stainless steel 316 L surface.

EXAMPLE 1

Nature of the treated surface: stainless steel 316 L.

Oxidizing pretreatment in the acid medium:

Solution of $KMnO_4$, whose molarity is 0.006 M. and $HNO_3$, whose molarity is 0.035 M.

Solution temperature: 80° C.

Treatment duration: 24 h.

Rinsing with demineralized water: 1 h.

Reducing treatment:

Solution of sodium gluconate with a molarity of 1 M. and soda with a molarity of 0.25 M.

Solution temperature: 80° C. pH=11.

Treatment time: 24 h.

The erosion obtained is 1.28 μm, i.e. 10 g/m$^2$.

EXAMPLE 2

Nature of the treated surface: stainless steel 316 L.

Oxidizing pretreatment in acid medium:

Solution and conditions identical to those of Example 1.

Rinsing with demineralized water: 1 h.

Reducing treatment:

Solution of sodium gluconate with a molarity of 0.5 and soda with a molarity of 0.1 M.

Solution temperature: 80° C. pH=11.

Duration of treatment: 24 h.

Result: the erosion obtained is 0.05 μm, i.e. 0.04 g/m$^2$.

We claim:

1. Process for the radioactive decontamination of metal surfaces, particularly portions of primary circuits of water-cooled nuclear reactors, comprising the steps of contacting said surfaces during an oxidizing pretreatment with a solution of $KMnO_4$ and nitric acid and then rinsing said surfaces with demineralized water, and then contacting said surfaces during a reducing treatment in a basic medium with an alkali metal gluconate solution of formula $HOH_2C—CHOH—CHOH—CHOH—CHOH—COOM$, in which M is an alkali metal chosen from among Na and K, and NaOH, said oxidizing pretreatment solution having a molar composition of $KMnO_4$ between 0.006 and 0.1 M. and a molar composition of nitric acid $HNO_3$ between 0.035 and 0.1 M., said metal surfaces being contacted with said oxidizing pretreatment solution at a temperature of approximately 80° C. for approximately 24 hours, said alkali metal gluconate solution having a molar composition of alkali metal gluconate between 0.05 and 1 M. and a molar composition of NaOH between 0.1 and 1 M., the temperature of the solution being approximately 80° C. and its pH approximately 11.

2. Decontamination process according to claim 1, characterized in that the reducing treatment in the basic medium is performed with the aid of a solution having a molar composition of sodium gluconate close to 0.5 M. and a molar composition of NaOH close to 0.1 M., the temperature of the solution being approximately 80° C. and its pH close to 11.

* * * * *

UNITED STATES PATENT AND TRADEMARK OFFICE

CERTIFICATE OF CORRECTION

PATENT NO. : 5,093,072

DATED : March 3, 1992

INVENTOR(S) : Guy Brunel et al.

It is certified that error appears in the above-identified patent and that said Letters Patent is hereby corrected as shown below:

On the title page, Section [75] Inventors: The first inventor should be indicated as --Guy Brunel-- instead of "Brunel Guy".

Column 1, line 61, after "surface" insert -- , --.

Signed and Sealed this

Sixth Day of July, 1993

Michael K. Kirk

*Attest:*

MICHAEL K. KIRK

*Attesting Officer*

*Acting Commissioner of Patents and Trademarks*